US009380685B2

(12) United States Patent
Shet et al.

(10) Patent No.: US 9,380,685 B2
(45) Date of Patent: Jun. 28, 2016

(54) BYPASS CIRCUIT FOR NEUTRAL-LESS CONTROLLER IN LIGHTING CONTROL SYSTEM

(71) Applicant: KONINKLIJKE PHILIPS N.V., Eindhoven (NL)

(72) Inventors: Deepak Shivaram Shet, Hoffman Estates, IL (US); Prasannakumar Gore, Buffalo Grove, IL (US); Sreeraman Venkitasubrahmanian, Naperville, IL (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/415,922

(22) PCT Filed: Jul. 5, 2013

(86) PCT No.: PCT/IB2013/055516

§ 371 (c)(1),
(2) Date: Jan. 20, 2015

(87) PCT Pub. No.: WO2014/013381

PCT Pub. Date: Jan. 23, 2014

(65) Prior Publication Data

US 2015/0181682 A1 Jun. 25, 2015

Related U.S. Application Data

(60) Provisional application No. 61/673,772, filed on Jul. 20, 2012.

(51) Int. Cl.

| | |
|---|---|
| ***H05B 37/03*** | (2006.01) |
| ***H05B 33/08*** | (2006.01) |
| ***H05B 41/392*** | (2006.01) |
| ***H05B 37/02*** | (2006.01) |

(52) U.S. Cl.

CPC ..... *H05B 37/03* (2013.01); *H05B 33/0806* (2013.01); *H05B 37/0272* (2013.01); *H05B 37/0281* (2013.01); *H05B 41/392* (2013.01)

(58) Field of Classification Search

CPC ..... H05B 41/3921; H05B 41/2985; H05B 41/3924; H05B 37/0263; H05B 41/2828; H05B 41/2981; H05B 41/2988; H05B 41/3925; H05B 41/2827; H05B 41/2855; H05B 41/36; H05B 41/392; H05B 41/42; H05B 33/08

See application file for complete search history.

(56) References Cited

U.S. PATENT DOCUMENTS

| | | | |
|---|---|---|---|
| 7,564,227 | B2 | 7/2009 | Dobbins et al. |
| 2006/0273775 | A1 | 12/2006 | Dobbins et al. |

(Continued)

FOREIGN PATENT DOCUMENTS

| | | | |
|---|---|---|---|
| WO | 2011045371 | A1 | 4/2011 |
| WO | 2011051859 | A1 | 5/2011 |
| WO | 2013136241 | A1 | 9/2013 |

OTHER PUBLICATIONS

"RF Local Controls, Wiring Diagrams", Maestro Wireless, Lutron, Designer-Style: Maestro, Sep. 30, 2010.

*Primary Examiner* — Douglas W Owens
*Assistant Examiner* — Monica C King

(57) ABSTRACT

A device provides a bypass path for leakage current of a neutral-less controller in a lighting control system for selectively supplying line voltage to a load. The device includes a dummy load, a voltage sensor, a bypass switch, a switch controller and a delay timer. The voltage sensor senses line voltage at an output of the neutral-less controller. The bypass switch selectively connects the dummy load in parallel with the lighting load. The switch controller activates the bypass switch to connect the dummy load in parallel with the lighting load when the line voltage is low, providing a bypass path for the leakage current, and deactivates the bypass switch after a delay period to disconnect the dummy load from being in parallel with the lighting load when the line voltage is high. The delay timer implements the delay period in response to the line voltage transitioning from low to high.

20 Claims, 7 Drawing Sheets

(56) References Cited

U.S. PATENT DOCUMENTS

| | | | | |
|---|---|---|---|---|
| 2007/0159153 | A1 | 7/2007 | Fricke et al. | |
| 2012/0126714 | A1 | 5/2012 | Deppe et al. | |
| 2012/0139431 | A1 | 6/2012 | Thompson et al. | |
| 2012/0274216 | A1* | 11/2012 | Datta | H05B 33/0815 315/127 |
| 2014/0015421 | A1* | 1/2014 | Mituyasu | H05B 33/08 315/158 |

* cited by examiner

BYPASS CIRCUIT FOR NEUTRAL-LESS CONTROLLER IN LIGHTING CONTROL SYSTEM

CROSS-REFERENCE TO PRIOR APPLICATIONS

This application is the U.S. National Phase application under 35 U.S.C. §371 of International Application No. PCT/IB13/055516, filed on Jul. 5, 2013, which claims the benefit of U.S. Provisional Patent Application No. 61/673,772, filed on Jul. 20, 2012. These applications are hereby incorporated by reference herein.

TECHNICAL FIELD

The present invention generally relates to lighting control systems. More particularly, embodiments of the present invention are directed to a bypass circuit in a lighting control system for providing a bypass path for leakage current of a neutral-less controller, such as a switch, when the lighting load is turned off.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g., red, green, and blue, as well as a processor for independently controlling the output of the LEDs in order to generate a variety of colors and color-changing lighting effects.

In many conventional lighting arrangements, a mechanical wall switch is used to turn ON or OFF a lighting unit by means of making or breaking an electrical connection between a load that includes the lighting unit, and a "hot" wire carrying power from the AC mains power source. Accordingly, the mechanical wall switch does not need a connection to the neutral wire from AC mains in order to turn ON and OFF the lighting unit, but instead only has an input terminal for being connected to the "hot" wire carrying power from the AC mains power source, and output terminal for supplying this power to the load when the switch turns ON the lighting unit (for safety reasons, the mechanical wall switch may also have a ground wire which does not supply any power to the wall switch or the load and which is connected to earth ground). As a result, in many existing buildings, the neutral wire from the AC mains power source is not provided to the junction box or other location where the mechanical wall switch is provided, but instead only the "hot" wire, and a wire to the load, are provided to this location (again, for safety reasons, a ground wire which does not supply any power to the wall switch or the load may also be provided and connected to earth ground). The load may include one or more lighting units, each of which may include a lighting driver and one or more light sources, such as an incandescent lamp, a fluorescent lamp (such as a compact fluorescent bulb), one or more LEDs. The load also may or may not include a ballast.

As energy saving requirements become more stringent, along with the need for intelligent lighting systems, more and more electronic controllers which employ electronic switching and dimming capabilities are deployed in place of simple mechanical wall switches in residential and commercial installations. The operation of such an electronic controller is similar to that of a mechanical wall switch, but due to the electronic circuit inside the lighting controller the electronic controller may execute additional functions, such as switching on or off a relay, dimming, switching on or off and/or dimming according to programmed timing, switching on or off and/or dimming according to various sensor inputs, wireless communications, etc. So, unlike a simple mechanical wall switch, the electronic lighting controller requires some energy for proper operation, e.g., even when the load is off.

For example, an Occuswitch Wireless Control System, available from Koninklijke Philips Electronics N.V, is an energy-saving occupancy sensor system that automatically turns lights off in an unoccupied room. As for the electronic controllers mentioned above, the Occuswitch Wireless Control System is a neutral-less electronic lighting controller, and behaves like a voltage feed when in a switch OFF state and like a current feed supply when in a switch ON state.

A neutral-less electronic lighting controller generally needs a small leakage current during the OFF state (removing power from the load) and a minimum current during the ON state (providing power to the load). However different loads have different characteristics, making it difficult to maintain a steady power supply. For example, when load impedance of a ballast is relatively large during the OFF state, the leakage current of the electronic lighting controller can develop sufficient voltage to cause the ballast to start up, which may cause lighting units to flash. During the ON state, the load needs to draw sufficient current to supply the neutral-less electronic lighting controller. Generally most ballasts have a start time during which the supply capacitors charge up and the ballasts draw very little current during this time. Also, during a preheat phase of programmed start ballasts, for example, the ballasts draw very little current. This will cause the neutral-less controller to dip during this time.

However, if the electronic controller is connected in place of a mechanical wall switch in front of the load, the maximum available power for the electronic controller is determined by the leakage current and the characteristics of the load, which is in series with the electronic controller. In some cases, for example those involving a dimming ballast having very limited leakage current, there is not a sufficient leakage current passing through the electronic controller when the load is turned OFF to keep the electronic switch operating properly. As a result, the lighting system may not operate properly.

FIG. 1 is a block diagram for a conventional lighting control system 100 which illustrates the issue. Lighting control system 100 includes a load 120 and an electronic controller 130.

The load 120 may include one or more lighting units and/or a motor (e.g., for a room fan). The lighting unit(s) may include lighting units each may include a lighting driver and one or more light sources, such as an incandescent lamp, a fluorescent lamp (such as a compact fluorescent bulb), one or more light emitting diodes (LEDs), etc. The load 120 also may or may not include a ballast. The load 120 has the first load terminal and a second load terminal, and is configured to receive a load voltage between the first and second load terminals and is further configured to allow a load current to flow between the first and second load terminals.

Electronic controller 130 has a single input terminal connected via a wire (e.g., a black wire) to a first power terminal 110 of an external power source 105 (e.g., AC mains), which outputs an AC voltage between first power terminal 110 and a second power terminal (e.g., a neutral terminal) 112 thereof.

Also shown is a ground wire (e.g., a green wire) 114 which is connected to earth ground and which does not supply any power to the electronic controller 130 or the load 120. The electronic controller 130 also has a single output terminal which is connected by a wire (e.g., a red wire) to the first load terminal of the load 120. The second load terminal of the load 120 is connected by a wire (e.g., a neutral wire, which may be a white wire) to the second power terminal 112 of the external power source 105.

When the electronic controller 130 is in the ON state so as to power the load 120, then the load 120 can receive as its load voltage 100% of the input voltage supplied from the external power source 105. When the electronic controller 130 is in the OFF state so as to disable the load 120, then the load voltage across the load 120 will be zero.

However, since the electronic controller 130 is an electrical device which requires power to operate, the situation can become complicated. When electronic the controller 130 is in the ON state, if the load voltage across the load 120 is 100% of the input voltage supplied from the external power source 105, then the voltage across the electronic controller 130 will be zero, and it can not remain in the ON state for long. Meanwhile, when the electronic controller 130 is in the OFF state, there will be no load voltage across the load 120 and no load current flowing through the load 120. However this means that there will also be no current, or very little current, passing through the electronic controller 130, so it cannot maintain the OFF state either, if it requires more energy.

To address these issues, some electronic controllers are designed to modulate the time intervals when they are in the ON and OFF states. When the electronic controller is in the ON state, it will switch to the OFF state for a little while, (e.g., OFF for 2 ms during every 10 ms ON period), so that during this interval the electronic controller can receive 100% of the input voltage supplied from the external power source 105 and thereby power itself. Meanwhile, when the electronic controller is in OFF state, it maintains a small leakage current flowing through the load, and with such leakage current, the electronic controller can power itself as well.

However, along with the technology development and more features like wireless communication required for lighting control, power consumption of an electronic controller increases significantly, and the intrinsic leakage current of the load itself is not sufficient to power the electronic controller when it is in the OFF state.

FIG. 2 is a block diagram for another conventional lighting control system 200 which has been provided to try to address this issue. The lighting control system 200 is identical to the lighting control system 100, except that the lighting control system 200 includes an external capacitor 210 connected across the load terminals of the load 120. Whether the electronic controller 130 is in an ON state or an OFF state, the external capacitor 210 can provide a leakage current path for the electronic controller 130. The bigger the capacitor, the more leakage current can be delivered to the electronic controller 130 to support activities consuming much current and power (e.g., receiving a wireless control signal).

However, if the electronic controller 120 includes a TRIAC based device, also known as leading edge dimmer, then the external capacitor 210 will cause catastrophic damage to TRIAC in terms of huge inrush current every cycle. Additionally, the external capacitor 210 will shift the phase of voltage and current at the load side, making the phase cutting of the dimming operation out of control.

Thus, it would be desirable to provide a lighting control system which can supply a necessary leakage current to a controller when the controller is in an OFF state and disables a load having power supplied by the controller. It would be further desirable to provide a lighting control system which can supply a necessary leakage current to a controller when the controller initially transitions to the ON state, while the load having power supplied by the controller begins to draw sufficient current for operation of the controller.

SUMMARY

The present disclosure is directed to inventive apparatuses and methods for supplying necessary leakage current to a neutral-less controller when the controller is in an OFF state, disabling a load having power supplied by the controller, and when the controller initially transitions to an ON state, while current drawn by the load is increasing to a minimum current required for operation of the controller.

Generally, in one aspect, a device for providing a bypass path for leakage current of a neutral-less controller in a lighting control system configured to selectively supply a line voltage to a lighting load includes a dummy load, a voltage sensor, a bypass switch, a switch controller and a delay timer. The voltage sensor is configured to sense the line voltage at an output terminal of the neutral-less controller. The bypass switch is configured to selectively connect the dummy load in parallel with the lighting load. The switch controller is configured to activate the bypass switch to connect the dummy load in parallel with the lighting load when the sensed line voltage is low to provide a bypass path for the leakage current, and to deactivate the bypass switch after a delay period to disconnect the dummy load from being in parallel with the lighting load when the sensed line voltage is high. The delay timer is configured to implement the delay period in response to the sensed line voltage transitioning from low to high.

In another aspect, a device for providing a bypass path for leakage current of a neutral-less controller in a lighting control system includes a bypass switch, a switch controller and a delay timer, where the neutral-less controller has a power switch configured to supply a line voltage to a lighting load when activated and to remove the line voltage from the lighting load when deactivated. The bypass switch is configured to selectively connect a dummy load in parallel with the lighting load in response to operation of the power switch in the neutral-less controller. The switch controller is configured to activate a bypass switch in response to deactivation of the power switch in the neutral-less controller, connecting a dummy load in parallel with the lighting load, and to deactivate the bypass switch in response to activation of the power switch in the neutral-less controller, disconnecting the dummy load from the lighting load, after a delay period. The delay timer is configured to determine the delay period in response to the activation of the power switch in the neutral-less controller.

In another aspect, a method provides a bypass path for leakage current of a neutral-less controller configured to selectively connect a lighting load to a voltage source. The method includes sensing a line voltage at an output of the neutral-less controller; activating a bypass switch to connect a dummy load in parallel with the lighting load when the sensed line voltage is low, indicating the lighting load is disconnected from the voltage source; and deactivating the bypass switch to disconnect the dummy load from being in parallel with the lighting load when the sensed line voltage transitions to high, indicating the lighting load is connected to the voltage source via the neutral-less controller, after a delay period during which the bypass switch continues to be activated, the delay period enabling the lighting load to draw minimum supply current for operation of the neutral-less controller.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs).

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, and other types of electroluminescent sources.

A "lighting driver" is used herein to refer to an apparatus that supplies electrical power to one or more light sources in a format to cause the light sources to emit light. In particular, a lighting driver may receive electrical power in a first format (e.g., AC mains power; a fixed DC voltage; etc.) and supplies power in a second format that is tailored to the requirements of the light source(s) (e.g., LED light source(s)) that it drives.

The term "lighting module" is used herein to refer to a module, which may include a circuit board (e.g., a printed circuit board) having one or more light sources mounted thereon, as well as one or more associated electronic components, such as sensors, current sources, etc., and which is configured to be connected to a lighting driver. Such lighting modules may be plugged into slots in a lighting fixture, or a motherboard, on which the lighting driver may be provided. The term "LED module" is used herein to refer to a module, which may include a circuit board (e.g., a printed circuit board) having one or more LEDs mounted thereon, as well as one or more associated electronic components, such as sensors, current sources, etc., and which is configured to be connected to a lighting driver. Such lighting modules may be plugged into slots in a lighting fixture, or a motherboard, on which the lighting driver may be provided.

The terms "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry; a lighting driver) relating to the operation of the light source(s). An "LED-based lighting unit" refers to a lighting unit that includes one or more LED-based light sources as discussed above, alone or in combination with other non LED-based light sources.

The terms "lighting fixture" and "luminaire" are used herein interchangeably to refer to an implementation or arrangement of one or more lighting units in a particular form factor, assembly, or package, and may be associated with (e.g., include, be coupled to and/or packaged together with) other components.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

In accordance with the understanding that a patent applicant may be his or her own lexicographer, as used herein a "two-wire connection" is specifically defined to be a connection which employs exactly two wires or terminals. A "two-wire connection" as used within the meaning of this specification and claims specifically does not include a connection which employs three (or more) wires.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally may refer to the same parts throughout the different views of the same embodiment. Also, the drawings are not necessarily to scale, emphasis instead generally being placed upon illustrating the principles of the invention.

DETAILED DESCRIPTION

As discussed above, a controller for selectively supplying power to a load may be installed in a location where only one wire or connection is available to only one power terminal of an external power source, which supplies power to the controller and load (i.e., the neutral wire is provided only to the load). In these installations, there is no return current path from the controller to the external power source, other than through the load itself. Therefore there is a need to provide a return current path for the controller when the controller is in an OFF state and the load is disabled.

Therefore, Applicant has recognized and appreciated that it would be beneficial to provide a bypass current (or leakage current) path between an output of the controller and a second power terminal of the external power source when the controller is in an OFF state, disabling the load. It would also be beneficial to disconnect or disable the leakage current path between the output terminal of the controller and the second power terminal of the external power source when the controller is in an ON state, powering the load. This may prevent wasted power consumption in the leakage current path when the controller is on an ON state and powers the load. In an embodiment, the leakage current path is disabled after a delay period, during which the load is allowed to begin drawing a normal amount of current. The delay period may be determined for each time the leakage current path is disabled (i.e., each time the controller is turned ON to supply power to the load).

In view of the foregoing, various embodiments and implementations of the present invention are directed to a bypass circuit that is selectively connected to an output terminal of a controller and which provides a bypass current (or leakage current) path between the output terminal of the controller and a second power terminal of the external power source when the controller is in an OFF state and disables the load. Other embodiments and implementations are directed to a lighting control arrangement that includes such a bypass circuit. Still other embodiments and implementations are directed to a method which enables a leakage current path between the output terminal of the controller and a second power terminal of the external power source when the controller is in an OFF state, disabling the load, and which disconnects or disables the leakage current path between the output terminal of the controller and the second power terminal of the external power source when the controller transitions to an ON state and powers the load, after a delay period during which the load begins drawing minimum current sufficient to operate the controller.

Figure 1:
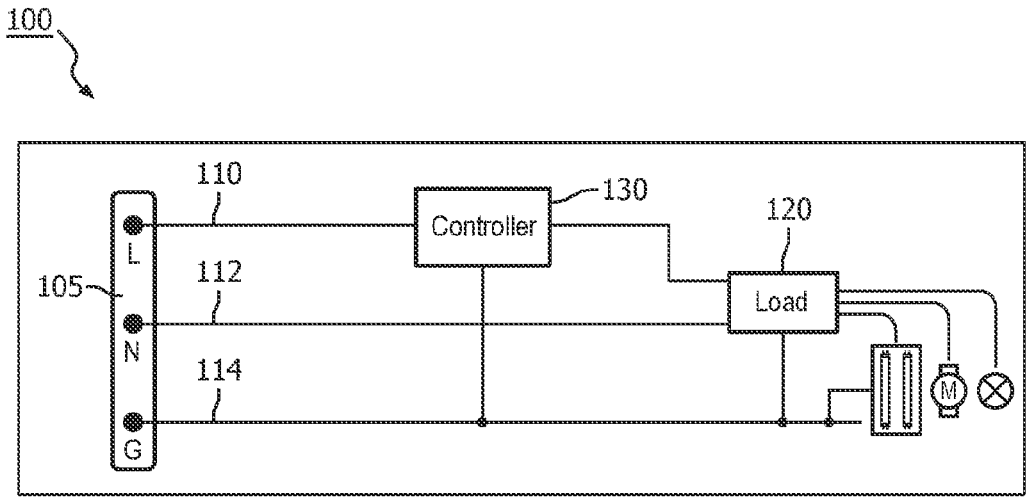
Prior Art FIG. 1
FIG. 1 is a block diagram of a conventional lighting control system
Figure 2:
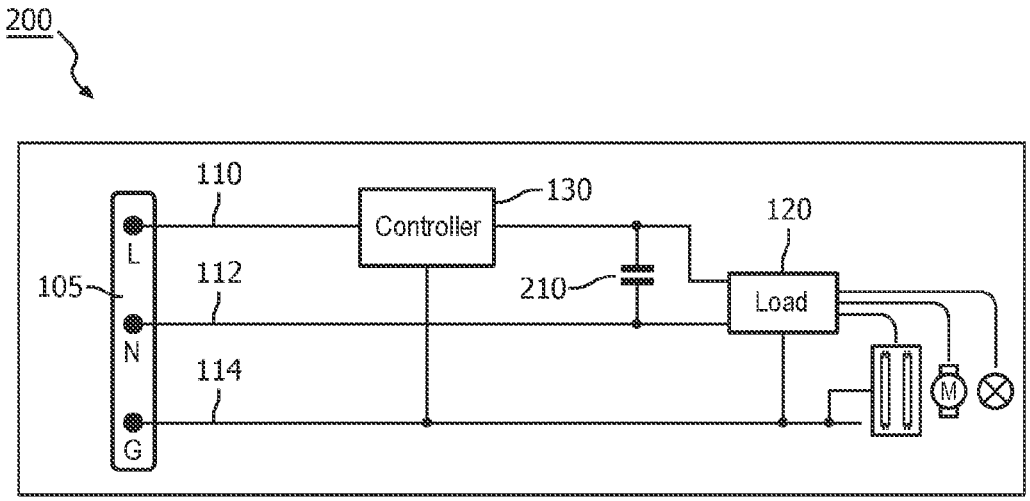
Prior Art FIG. 2
FIG. 2 is a block diagram of another conventional lighting control system.
Figure 3:
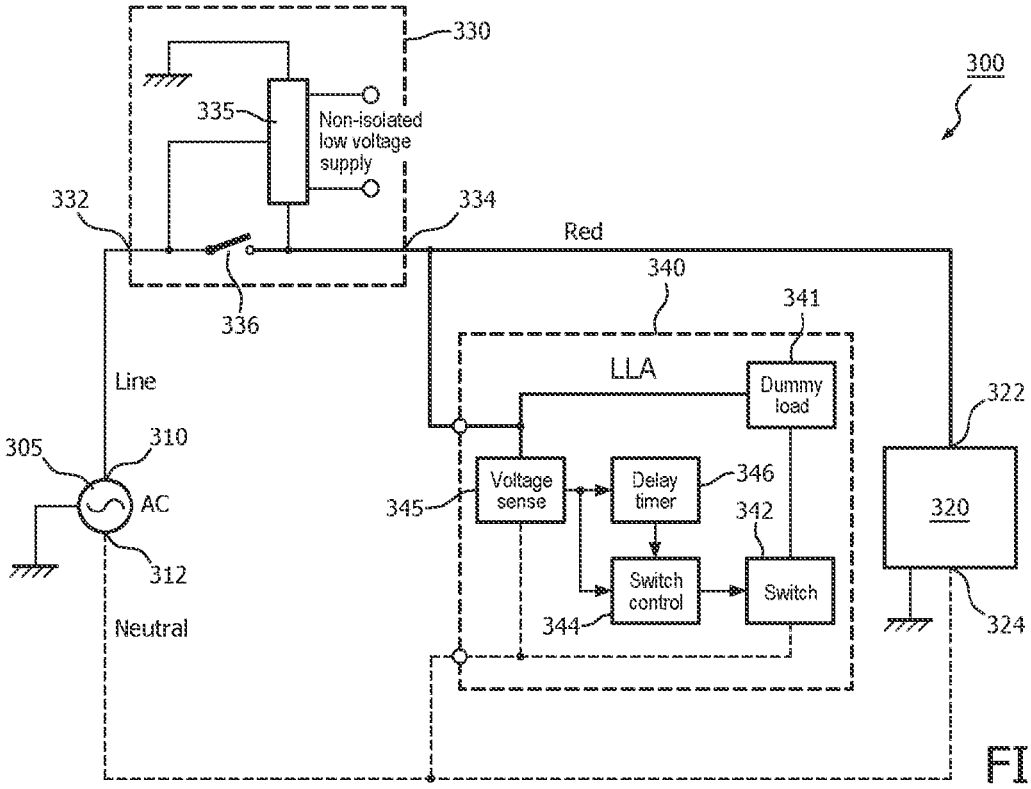
FIG. 3 is a block diagram of a lighting control system having a bypass circuit for a neutral-less controller, according to a representative embodiment.

FIG. 3 is a block diagram of an embodiment of a lighting control system 300, according to a representative embodiment. Referring to FIG. 3, the lighting control system 300 includes an external power source 305 (e.g., AC mains) and a neutral-less electronic controller 330 (which does not employ a neutral wire) that controls supply of power to a representative load 320. The lighting control system 300 further includes controllable bypass circuit 340, which selectively provides a bypass current (or leakage current) path between an output terminal 334 of the electronic controller 330 and a second power terminal 312 of the external power source 305 in response to the ON/OFF state of the electronic controller 330, as well as the current draw of the load 320.

The load 320 may include one or more lighting units and/or a motor (e.g., for a room fan). The lighting unit(s) each may include a lighting driver and one or more light sources, such as an incandescent lamp, a fluorescent lamp (such as a compact fluorescent bulb), one or more LEDs, etc. The load 320 also may or may not include a ballast. The load 320 includes a first load terminal 322 and a second load terminal 324, and is configured to receive a load voltage from the external power source 305 between the first and second load terminals 322 and 324, and to allow a load current to flow between the first and second load terminals 322 and 324.

The controller 330 has a single input terminal 332 connected via a wire (e.g., hot wire, which may be a black wire) to a first power terminal (e.g., hot terminal) 310 of the external power source 305, which outputs an AC voltage between the first power terminal 310 and the second power terminal (e.g., neutral terminal) 312 thereof. A ground wire (not shown), which is connected to earth ground and which does not supply any power to controller 330 or load 320, may also be provided for safety reasons. The single output terminal 334 of the controller 330 is connected by a wire (e.g., which may be a red wire) to the first load terminal 322 of the load 320. The second load terminal 324 of the load 320 is connected by a wire (e.g., neutral wire, which may be a white wire) to the second power terminal 312 of the external power source 305.

In some embodiments of lighting control system 300, the controller 330 may be installed in a junction box or a wall of a building, and may be located remotely from (e.g., by a distance of one foot to several feet) from the load 320. In some embodiments, a connection to the second power terminal 312 of the external power source 305 is not provided to or available at the location of the controller 330, and only a connection to the first power terminal 310 is available (e.g., through the hot wire). In some embodiments, the bypass circuit 340 may be co-located with the load 320. For example, the bypass circuit 340 may be provided inside of a lighting fixture, or housed together with a lighting device comprising the load 320.

In some embodiments, the controller 330 is an electronic controller that selectively provides power to the load 320, such as a remotely operable and/or programmable switch. For example, the controller 330 may include a microprocessor that can be programmed to provide one or more sets of ON/OFF times for supplying power to the load 320. In some embodiments, the controller 330 is an electronic controller which includes a dimming circuit for adjusting an amount of power supplied to the load 320 in response to a dimming signal (which may be, e.g., a setting of a dimming knob or slide-control of controller 330 which may be adjusted by a user). In some embodiments, the controller 330 includes a wireless receiver configured to receive a wireless signal which includes data and/or commands for the controller 330 to control the supply of power and/or the amount of power supplied to load 320. For example, as mentioned above, the controller 330 may be an Occuswitch Wireless Control System, available from Koninklijke Philips Electronics N.V. In the depicted embodiment, the controller 330 includes power switch 336 for selectively connecting and disconnecting the load 320 to and from the external power source 305. The controller 330 also includes internal, non-isolated low voltage supply 335, which continually provides power for controlling the power switch 336 and/or a microprocessor or other control device (not shown) when the power switch 336 is otherwise deactivated. Notably, the various embodiments are not limited to the types of neutral-less controllers indentified herein.

The bypass circuit 340 is connected to the output terminal 334 of the controller 330, and is connected to the second terminal 312 of the external power source 305 via a wire (e.g., neutral wire, which may be a white wire). In other words, the bypass circuit 340 is connectable in parallel with the load 320. The bypass circuit 340 includes a dummy load 341 connected in series with a bypass switch 342, which is controlled by a switch controller 344 to selectively connect the dummy load 341 in parallel with the load 320, as discussed below. In some embodiments, the dummy load 341 may be a low ohmic resistive load, which provides the leakage current path and keeps the load voltage very low. The dummy load 341 may include one or more resistors connected in series, for example, having a combined resistive load of about 1 kOhm. In some embodiments, the bypass switch 342 may include a transistor switch, such as a field effect transistor (FET) or a metal oxide semiconductor field effect transistor (MOSFET), for example. In alternative configurations, the bypass switch may be an insulated gate bipolar transistor (IGBT) or a bipolar junction transistor (BJT), for example, without departing from the scope of the present teachings. The bypass switch 342 is configured to have a switching time of less than 10 milliseconds, for example.

The bypass circuit 340 further includes a voltage sensor 345 connected in parallel with the dummy load 341 and a delay timer 346 connected to the voltage sensor 345 and the switch controller 344. The voltage sensor 345 is configured to detect the level of voltage (e.g., line voltage) at the output terminal 334 of the controller 330. Generally, the line voltage is low when the controller 330 is in the OFF state (i.e., the power switch 336 of the controller 330 is open or deactivated), such that no power is provided to the load 320, and the line voltage is high when the controller 330 is in the ON state (i.e., the power switch 336 is closed or activated), such that power is provided to the load 320.

Operationally, the controller 330 is configured to control at least one of the load voltage and the load current, so as to selectively power the load 320 and disable the load 320. As described above, the controller 330 may control the load voltage and/or load current in response to a programming input, a dimming input (e.g., by a knob or slider manipulated by a user), and/or a wireless control signal for turning the controller 330 ON/OFF or for adjusting a dimming level, for example. In some embodiments, the controller 330 may be responsive to various other types of input, without departing from the scope of the present teachings.

The bypass circuit 340 is configured to determine when the controller 330 enters an OFF state disabling load 320 and enters an ON state powering the load 320. In response, the bypass circuit 340 connects the dummy load 341 in parallel with the load 320 when the controller 330 enters the OFF state, and disconnects the dummy load 341 after a time delay determined by the delay timer 346 when the controller 330 enters the ON state, as described below.

Figure 4:
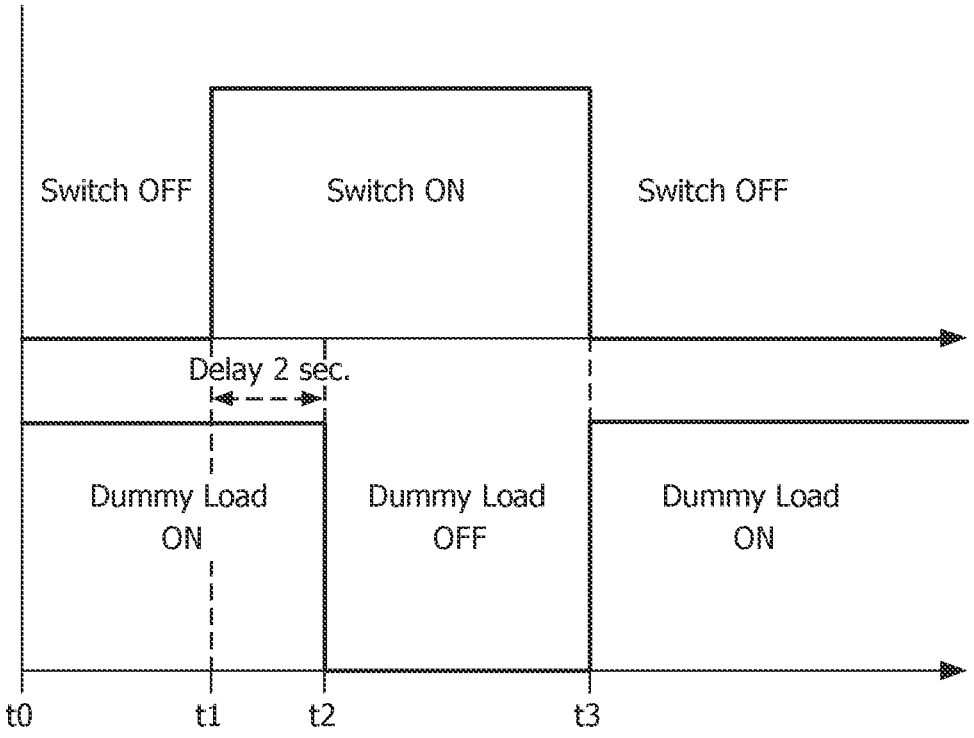
FIG. 4 is a signal diagram indicating operations of a power switch and a bypass switch, respectively, according to a representative embodiment.

FIG. 4 is a signal diagram indicating operations of the power switch 336 in the controller 330 and the bypass switch 342 in the bypass circuit 340, respectively. Referring to FIGS. 3 and 4, the power switch 336 in the controller 330 is indicated initially in the open (OFF) position at time t0, in which case the controller 330 is in the OFF state and no voltage and/or current is provided to the load 320. When the controller 330 is in the OFF state, e.g., from time t0 to time t1, the voltage sensor 345 of the bypass circuit 340 detects a low level of the line voltage output by the controller 330 at the output terminal 334. In response, the switch controller 344 closes the bypass switch 342, which connects the dummy load 341 in parallel with the load 320. This enables a leakage current to flow from the controller 330 through the dummy load 341, enabling the controller 330 to continue to be powered even though the controller 330 has no neutral connection and the load 320 is effectively OFF (and thus conducting no current). The delay timer 346 does not provide any delay when the controller 330 is in the OFF state, or when the controller 330 transitions from the ON state to the OFF state, as shown in FIG. 4.

At time t1, the power switch 336 in the controller 330 transitions to the closed (ON) position, in which case the controller 330 is in the ON state so that voltage and/or current is supplied to the load 320. When the controller 330 transitions to the ON state, the voltage sensor 345 of the bypass circuit 340 detects a high level of the line voltage output by the controller 330 at the output terminal 334. In response, after a delay period implemented by the delay timer 346, the switch controller 344 opens the bypass switch 342. The delay timer 346 initiates the delay period in response to the voltage sensor 345 first sensing the line voltage changing to the high level. The purpose of the delay period is to allow sufficient time for the load 320 to draw a sufficient amount of current to enable normal operation of the controller 330 before removing the dummy load 341 (and corresponding leakage current path). That is, the current drawn by the load 320 may be very low during an initial start-up period. For example, as mentioned above, ballasts of the load 320 may have a start time during which supply capacitors charge up, and/or programmed start ballasts of the load 320 may require a preheat phase, during which very low current is drawn.

Accordingly, the delay period imposed by the delay timer 346 must be long enough to enable the load 320 to begin drawing minimum supply current sufficient for proper operation of the controller 330. In FIG. 4, the delay period is indicated between times t1 and t2 (e.g., about 2 seconds). In some embodiments, the delay period may be a predetermined time period, calculated to generally cover anticipated characteristics of the load 320. In some embodiments, the delay timer 346 and/or the switch controller 344 actively determine the length of the delay period, in real-time or near real-time, during operation of the controller 330. For example, the length of the delay period may be determined by monitoring the amount of current drawn by the load 320, and then causing the bypass switch 342 to open (turn OFF) when the current drawn by the load 320 is sufficient (e.g., meets a minimum threshold) to enable proper operation of the controller 330. Thus, the leakage current continues to flow through the controller 330 and the dummy load 341 during the delay, enabling the controller 330 to continue to be powered even though it has no neutral connection and the load 320 has not yet begun drawing a sufficient amount of current. Generally, the delay period will be appreciably longer when the controller 330 is a neutral-less switch, for example, rather than a neutral-less dimmer.

All or part of the delay timer 346 and/or the switch controller 344 may be implemented by a computer processor (e.g., microprocessor or microcontroller), application specific integrated circuits (ASICs), field-programmable gate arrays (FPGAs), or combinations thereof, using software, firmware, hard-wired logic circuits, or combinations thereof. When using a processor, a memory may be included, such as a non-transitory computer readable medium, for storing executable software/firmware and/or executable code that allows it to perform the various functions.

At time t2, following the delay period imposed by the delay timer 346, the switch controller 344 opens the bypass switch 342, disconnecting the dummy load 341 from its parallel arrangement with the load 320. Therefore, the leakage current path is disabled and no leakage current flows through the dummy load 341. The controller 330 continues to be powered by current drawn by the load 320, which is effectively ON.

At time t3, the power switch 336 in the controller 330 transitions to the open (OFF) position, in which case the controller 330 is in the OFF state and no voltage and/or current is provided to the load 320. At that time, the voltage sensor 345 detects a low level of the line voltage output by the controller 330 at the output terminal 334, and the switch controller 344 closes the bypass switch 342, again connecting the dummy load 341 in parallel with the load 320. This enables the leakage current to flow through the controller 330 and the dummy load 341, enabling the controller 330 to continue to be powered. As shown in FIG. 4, the delay timer 346 does not provide any delay when the controller 330 transitions to the OFF state since the start-up characteristics of the load 320 are not a factor, as mentioned above.

Figure 5:
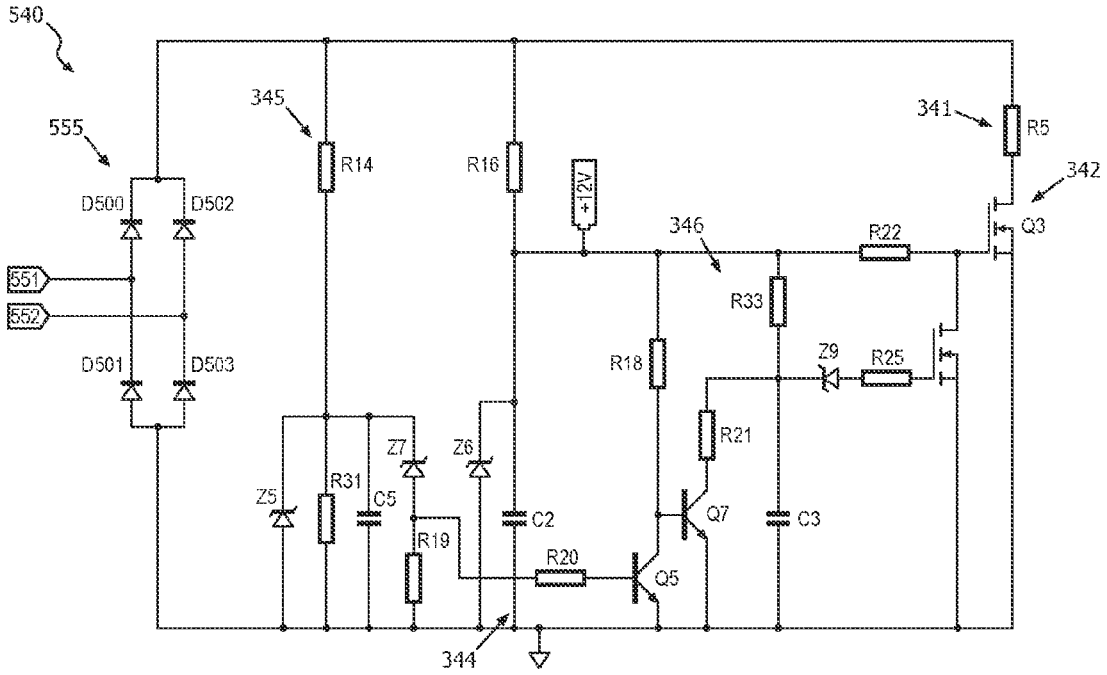
FIG. 5 is a circuit diagram of a bypass circuit for a neutral-less controller in a lighting control system, according to a representative embodiment.

FIG. 5 is a circuit diagram of a bypass circuit for a neutral-less controller in a lighting control system, according to a representative embodiment. In particular, FIG. 5 depicts bypass circuit 540, which is an exemplary implementation of the bypass circuit 340 in FIG. 3.

Referring to FIGS. 3 and 5, the bypass circuit 540 would be connected to the output terminal 334 of the controller 330 (not shown in FIG. 5) at first bypass terminal 551 and to the second power terminal 312 of the external power source 305 (not shown in FIG. 5) at second bypass terminal 552. The bypass circuit 540 would therefore be in parallel with the load 320 (not shown in FIG. 5), as discussed above. The bypass circuit 540 includes voltage rectifier 555, consisting of diodes D500 to D503, as well as additional input circuitry (not shown), such as one or more fuses and/or a transient surge protector, for example.

The dummy load 341 includes resistor R5 connected in series between the first bypass terminal 551 and transistor Q3. The transistor Q3 is the bypass switch 342, and may be implemented as a FET or MOSFET, for example. The gate of the transistor Q3 is connected to a 12V voltage source and circuitry of the switch controller 344 and the delay timer 346, discussed below, via resistor R22. Resistor R16, connected in series between the first bypass terminal 551 and the resistor R22, and the parallel arrangement of capacitor C2 and Zener diode Z6, provide the 12V voltage source. When the transistor Q3 is ON (e.g., the gate is at high voltage level), the dummy load 341 is connected to neutral (indicated as ground), so that it is in parallel with the load 320, providing a leakage current path for the neutral-less controller 330. When the transistor Q3 is OFF (e.g., the gate is at low level), the dummy load 341 is disconnected from neutral, after a delay period imposed by the delay timer 346, removing the leakage current path.

The voltage sensor 345 is an RC circuit including resistor R14, connected in series with capacitor C5, and resistor R31 and Zener diode Z5 each connected in parallel with the capacitor C5. The voltage sensor 345 is configured to detect the line voltage at the output terminal 334 of the controller 330. The detected line voltage is provided to the switch controller 344 and the delay timer 346. In the depicted embodiment, the delay timer 346 is effectively part of the circuitry of the switch controller 344, and includes resistor R33 and capacitor C3 connected between the 12V voltage supply and neutral. The gate of the transistor Q3 is connected to a node between the resistor R33 and the capacitor C3 of the delay timer 346 via resistor R25 and Zener diode Z9.

The switch controller 344 additionally includes transistor Q1, which may be implemented as a FET or MOSFET, for example, connected between the gate of the transistor Q3 and neutral. The switch controller 344 further includes transistor Q5 and transistor Q7, each of which may be implemented as a bipolar junction transistor (BJT). The base of the transistor Q5 is connected receive the detected voltage via resistor R20 from a node between Zener diode Z7 and resistor R19. The collector of the transistor Q5 is connected to the 12V voltage source via resistor R18 and to the base of the transistor Q7. The collector of the transistor Q7 is connected to the gate of the transistor Q1 via resistors R21 and R25 and Zener diode Z9. The transistor Q1 is therefore turned ON, turning OFF the transistor Q3 (the bypass switch 342), when the sensed voltage transitions to a high level, subject to the delay period imposed by the delay timer 346. The transistor Q1 is then turned OFF, turning ON the transistor Q3 (the bypass switch 342), when the sensed voltage transitions to a low level, connecting the dummy load 341 (resistor R5) in parallel with the load 320.

Figure 6:
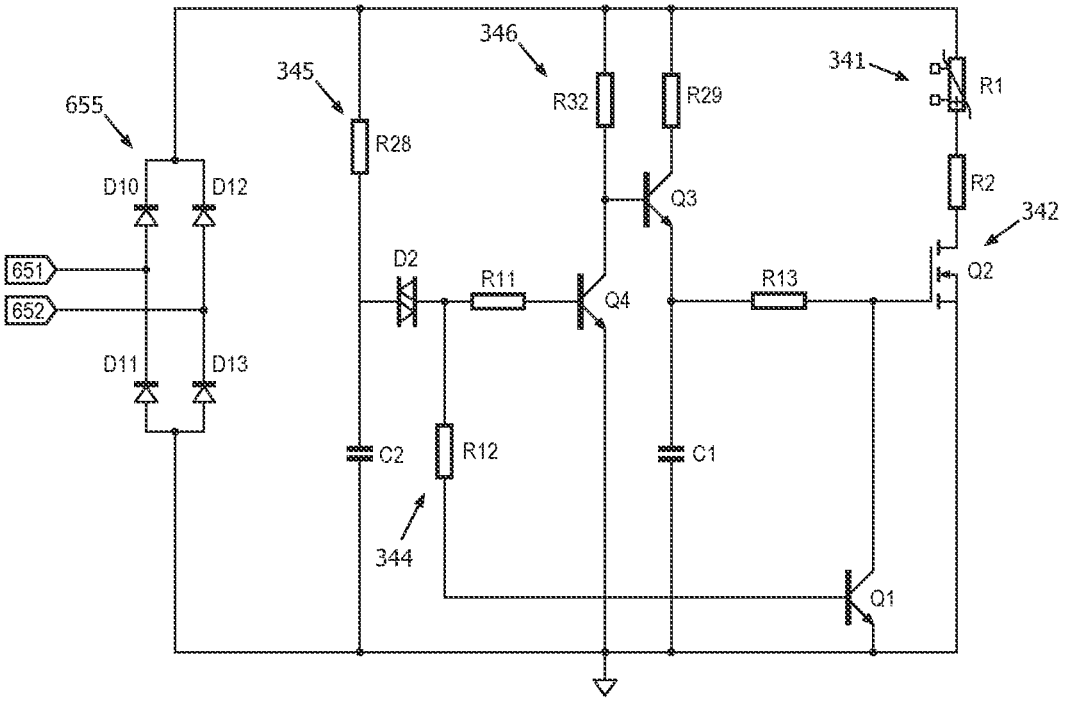
FIG. 6 is a circuit diagram of a bypass circuit for a neutral-less controller in a lighting control system, according to a representative embodiment.

FIG. 6 is a circuit diagram of a bypass circuit for a neutral-less controller in a lighting control system, according to another representative embodiment. In particular, FIG. 6 depicts bypass circuit 640, which is an exemplary implementation of the bypass circuit 340 in FIG. 3.

Referring to FIGS. 3 and 6, the bypass circuit 640 would be connected to the output terminal 334 of the controller 330 (not shown in FIG. 6) at first bypass terminal 651 and to the second power terminal 312 of the external power source 305 (not shown in FIG. 6) at second bypass terminal 652. The bypass circuit 640 would therefore be in parallel with the load 320 (not shown in FIG. 6), as discussed above. The bypass circuit 640 includes voltage rectifier 655, consisting of diodes D10 to D13, as well as additional input circuitry (not shown), such as one or more fuses and/or a transient surge protector, for example.

The dummy load 341 includes positive temperature coefficient (PTC) thermistor R1 and representative resistor R2 connected in series between the first bypass terminal 651 and transistor Q2. The transistor Q2 is the bypass switch 342, and may be implemented as a FET or MOSFET, for example. The gate of the transistor Q2 is connected to circuitry of the switch controller 344 and the delay timer 346, discussed below. When the transistor Q2 is ON (e.g., the gate is at high voltage level), the dummy load 341 is connected to neutral (indicated as ground), so that it is in parallel with the load 320, providing a leakage current path for the neutral-less controller 330.

When the transistor Q2 is OFF (e.g., the gate is at low level), the dummy load 341 is disconnected from neutral, after a delay period imposed by the delay timer 346, removing the leakage current path.

The voltage sensor 345 is an RC circuit including representative resistor R28 connected in series with capacitor C2. The voltage sensor 345 is configured to detect the line voltage at the output terminal 334 of the controller 330. The detected line voltage is provided to the switch controller 344 and the delay timer 346. In the depicted embodiment, the delay timer 346 is effectively part of the circuitry of the switch controller 344, and includes transistor Q3, representative resistor R32, and capacitor C1. The transistor Q3 may be a BJT, for example. The resistor R32 is connected between the first bypass terminal 651 and the base of the transistor Q3, and the capacitor C1 is connected between the emitter of the transistor Q3 and neutral. The collector of the transistor Q3 is connected to the first bypass terminal 651 via representative resistor R29. The gate of the transistor Q2 is connected to a node between the emitter of the transistor Q3 and the capacitor C1 of the delay timer 346 via resistor R13.

The switch controller 344 additionally includes transistor Q1 and transistor Q4, each of which may be implemented as a BJT, for example. The base of the transistor Q1 is connected to receive the detected voltage via resistor R12 and diac D2 from a node located between the resistor R28 and the capacitor C2 of the voltage sensor 345. The collector and the emitter of the transistor Q1 are connected to the gate of the transistor Q2 and neutral, respectively. When turned ON, the transistor Q1 turns OFF the transistor Q2. The base of the transistor Q4 is connected to receive the detected voltage via resistor R11 and diac D2 from the node located between the resistor R28 and the capacitor C2 of the voltage sensor 345. The collector and the emitter of the transistor Q4 are connected to the base of the transistor Q3 and neutral, respectively. When turned ON, the transistor Q4 prevents the delay timer 346 from activating, thus holding the transistor Q2 in the OFF state. The switch controller 344 may further include a Zener diode (not shown), connected between the emitter of the transistor Q3 and neutral, and configured to limit voltage across the capacitor C1, effectively protecting the gate of transistor Q2.

In operation, the PTC thermistor R1 provides protection for the circuit during the transition of the power switch 336 in the controller 330 from OFF to ON states by allowing load current to pass until the PTC thermistor R1 heats up and reduces current by changing to a high impedance state. The load current through the PTC thermistor R1 may be controlled by the resistor value of the resistor R2 in series. The dummy load 341 therefore has the required characteristics for the OFF to ON state transition. However, during ON to OFF state transition of the power switch 336, the PTC thermistor R1 slowly cools down to a low impedance state, allowing leakage current for neutral-less controller 330. To overcome this, the transistor Q2 (the bypass switch 342) may be used to turn OFF the PTC thermistor R1 and allow it to recover to low impedance state faster.

When voltage at the voltage sensor 345 is low (indicating the power switch 336 is OFF), the transistor Q3 is in the ON state. This allows the capacitor C1 to charge up and turn ON the transistor Q2 (the bypass switch 342), connecting the dummy load 341 (PTC thermistor R1, resistor R2) in parallel with the load 320. When voltage at the voltage sensor 345 increases above breakdown voltage of the diac D2 (e.g., 32V), the transistor Q2 is turned OFF, disconnecting dummy load 341 from the parallel connection with the load 320. The delay timer 346 (resistor R28 and capacitor C2) provides the delay to turn OFF the transistor Q3, allowing reduction of power consumed by the PTC thermistor R1 in the ON state of the power switch 336.

Figure 7:
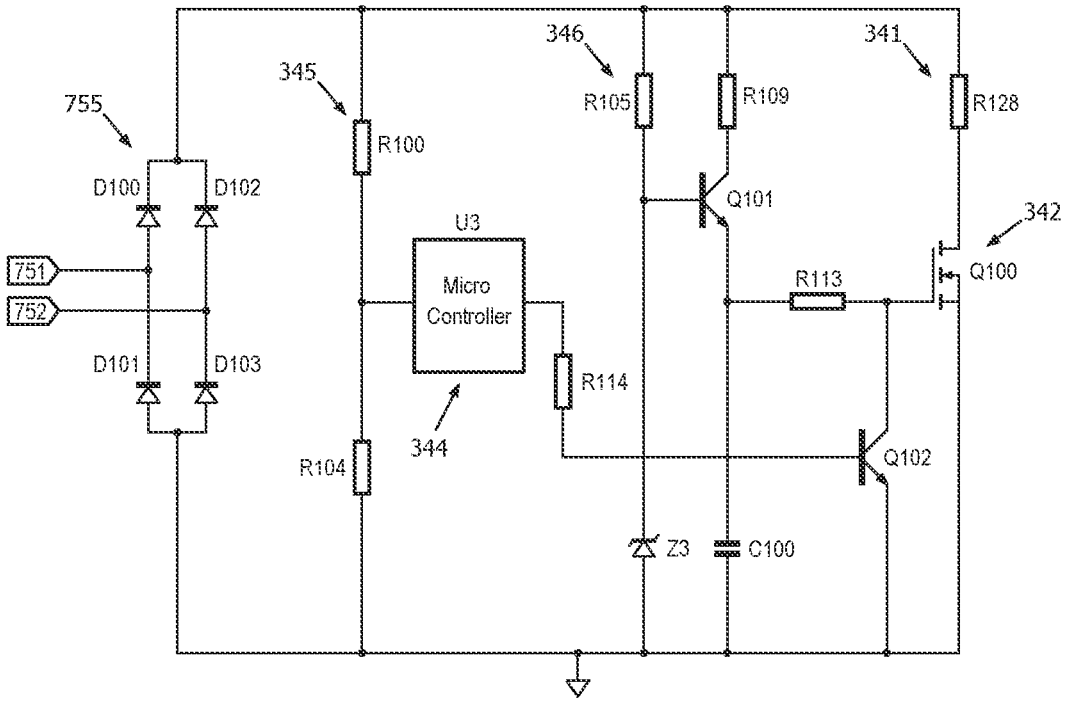
FIG. 7 is a circuit diagram of a bypass circuit for a neutral-less controller in a lighting control system, according to a representative embodiment.

FIG. 7 is a circuit diagram of a bypass circuit for a neutral-less controller in a lighting control system, according to a representative embodiment. In particular, FIG. 7 depicts bypass circuit 740, which is an exemplary implementation of the bypass circuit 340 in FIG. 3.

Referring to FIGS. 3 and 7, the bypass circuit 740 would be connected to the output terminal 334 of the controller 330 (not shown in FIG. 7) at first bypass terminal 751 and to the second power terminal 312 of the external power source 305 (not shown in FIG. 7) at second bypass terminal 752. The bypass circuit 740 would therefore be in parallel with the load 320 (not shown in FIG. 7), as discussed above. The bypass circuit 740 includes voltage rectifier 755, consisting of diodes D100 to D103, as well as additional circuitry (not shown), such as one or more fuses and/or a transient surge protector, for example. Further, unlike the exemplary bypass circuits 540 and 640 discussed above, the bypass circuit 740 includes a microcontroller (microcontroller U3) for implementing the switch controller 344. For example, the microcontroller U3 may be a model ST7FLITEU09 microcontroller, available from STMicroelectronics, although other types of microprocessors and microcontrollers may be implemented without departing from the scope of the present teachings.

The dummy load 341 includes representative resistor R128 connected in series between the first bypass terminal 751 and transistor Q100. The transistor Q100 is the bypass switch 342, and may be implemented as a FET or MOSFET, for example. The gate of the transistor Q100 is connected to circuitry of the switch controller 344 and the delay timer 346, discussed below. When the transistor Q100 is ON (e.g., the gate is at high voltage level), the dummy load 341 is connected to neutral (indicated as ground), so that it is in parallel with the load 320, providing a leakage current path for the neutral-less controller 330. When the transistor Q100 is OFF (e.g., the gate is at low level), the dummy load 341 is disconnected from neutral, after a delay period imposed by the delay timer 346, removing the leakage current path.

The voltage sensor 345 includes representative resistors R100 and R104 connected in series between the first bypass terminal 751 and neutral. The voltage sensor 345 is configured to detect the line voltage at the output terminal 334 of the controller 330. The detected line voltage is provided to the switch controller 344 and the delay timer 346. In the depicted embodiment, the delay timer 346 is effectively part of the circuitry of the switch controller 344, and includes transistor Q101, representative resistor R105, and capacitor C100. The transistor Q101 may be a BJT, for example. The resistor R105 is connected between the first bypass terminal 751 and the base of the transistor Q101, and the capacitor C100 is connected between the emitter of the transistor Q101 and neutral. The collector of the transistor Q101 is connected to the first bypass terminal 751 via representative resistor R109. The emitter of the transistor Q101 is also connected to the gate of the transistor Q100 via resistor R113. The base of the transistor Q101 is connected to a node between the resistor R105 of the delay timer 346 and Zener diode Z3, which is connected to neutral.

The switch controller 344 additionally includes transistor Q102 and microcontroller U3, mentioned above. The transistor Q102 may be implemented as a BJT, for example. The base of the transistor Q102 is connected to a data output of the microcontroller U3 via resistor R114 to receive a control signal responsive to the detected voltage provided by the voltage sensor 345. The collector and the emitter of the transistor Q102 are connected to the gate of the transistor Q100 and neutral, respectively, for turning the transistor Q100 ON and OFF.

In the depicted embodiment, the microcontroller U3 is connected to the voltage sensor 345 at a node between resistors R100 and R104 of the voltage sensor 345 to receive data indicating the detected voltage provided by the voltage sensor 345. The microcontroller U3 may be programmed to provide a variety of responses to the detected voltage. For example, the microcontroller U3 may control the transistor Q100 (the bypass switch 342) to turn ON and OFF (e.g., after a predetermined or calculated delay period) as shown in FIG. 4. Alternatively, the microcontroller U3 may be programmed to control leakage current of the controller 330 during the delay period and/or during the period when the dummy load 341 would otherwise be disconnected for the load 320, for example, as discussed below with reference to FIGS. 8A-8C.

For example, when voltage at the voltage sensor 345 is low (indicating the power switch 336 is OFF), the switch Q101 is in the ON state. This allows the capacitor C100 to charge up and turn ON the transistor Q100 (the bypass switch 342), connecting the dummy load 341 (resistor R120) in parallel with the load 320. When voltage at the voltage sensor 345 is high (indicating the power switch 336 is ON), the transistor Q100 is turned OFF, disconnecting dummy load 341 from the parallel connection with the load 320. In the depicted embodiment, the microprocessor U3 provides the delay to turn OFF the transistor Q100, while the delay timer 346 (resistor R105 and capacitor C100) are used for biasing the power switch 336 when the controller 330 is in the OFF state.

In each of the embodiments depicted above, alternative configurations may include IGBTs or BJTs in place of the various FETs or MOSFETs, and/or IGBTs, FETs or MOSFETs in place of the various BJTs, without departing from the scope of the present teachings.

Figure 8:
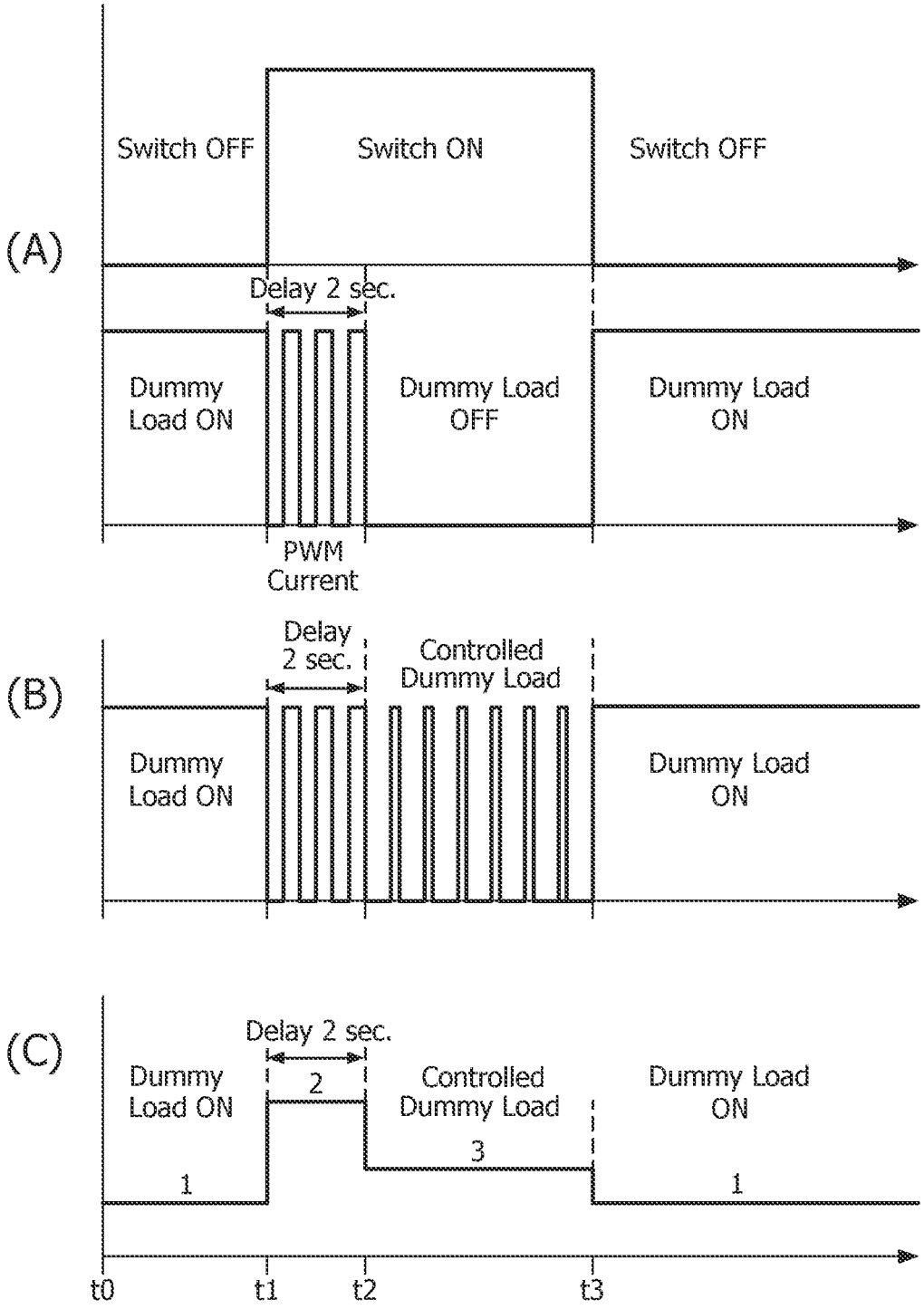
FIGS. 8A-8C are signal diagrams indicating operations of a power switch and a bypass switch, respectively, according to representative embodiments.

FIGS. 8(A)-8(C) are signal diagrams indicating operations of the power switch 336 in the controller 330 and the bypass switch 342 in the bypass circuit 340, respectively, according to alternative embodiments. In the depicted embodiments, operations of the bypass circuit 340 are controlled, at least in part, by a microprocessor, such as microcontroller U3 in FIG. 7. With microprocessor control it is possible to operate the bypass circuit 340 in different modes. A first mode is discussed above with reference to FIG. 4, in which the dummy load 341 remains connected during a delay period after the power switch 336 transitions from an open (OFF) position to a closed (ON) position. A second mode, shown in FIG. 8(A), is an enhancement of the first mode, where average leakage current is controlled during the delay period. A third mode, shown in FIGS. 8(B) and 8(C), allows lower leakage current while the power switch 336 is in the closed (ON) position. FIG. 8(C) in particular shows average leakage current for the third mode.

Referring to FIGS. 3 and 8(A), the power switch 336 in the controller 330 is indicated initially in the open (OFF) position at time t0, in which case the controller 330 is in the OFF state and no voltage and/or current is provided to the load 320. When the controller 330 is in the OFF state, e.g., from time t0 to time t1, the voltage sensor 345 of the bypass circuit 340 detects a low level of the line voltage output by the controller 330 at the output terminal 334. In response, the switch controller 344 closes the bypass switch 342, which connects the dummy load 341 in parallel with the load 320.

At time t1, the power switch 336 in the controller 330 transitions to the closed (ON) position, in which case the controller 330 is in the ON state so that voltage and/or current is supplied to the load 320. When the controller 330 transitions to the ON state, the voltage sensor 345 of the bypass circuit 340 detects a high level of the line voltage output by the controller 330 at the output terminal 334. In response, after a delay period implemented by the delay timer 346, the switch controller 344 opens the bypass switch 342. During the delay period, the average leakage current is controlled, e.g., by adjusting a duty cycle of a pulse width modulation (PWM) signal from the switch controller 344 to the bypass switch 342, to cycle the bypass switch 342 between open and closed positions at a desired rate corresponding to the average leakage current. As discussed above, the delay period must be long enough to enable the load 320 to begin drawing minimum supply current sufficient for proper operation of the controller 330. At time t2, following the delay period imposed by the delay timer 346, the switch controller 344 opens the bypass switch 342, disconnecting the dummy load 341 from its parallel arrangement with the load 320. Therefore, the leakage current path is disabled and no leakage current flows through the dummy load 341.

Referring to FIGS. 3, 8(B) and 8(C), the power switch 336 in the controller 330 is indicated initially in the open (OFF) position at time t0, in which case the controller 330 is in the OFF state and no voltage and/or current is provided to the load 320. When the controller 330 is in the OFF state, e.g., from time t0 to time t1, the voltage sensor 345 of the bypass circuit 340 detects a low level of the line voltage output by the controller 330 at the output terminal 334. In response, the switch controller 344 closes the bypass switch 342, which connects the dummy load 341 in parallel with the load 320.

At time t1, the power switch 336 in the controller 330 transitions to the closed (ON) position, in which case the controller 330 is in the ON state so that voltage and/or current is supplied to the load 320. When the controller 330 transitions to the ON state, the voltage sensor 345 of the bypass circuit 340 detects a high level of the line voltage output by the controller 330 at the output terminal 334. In response, after a delay period implemented by the delay timer 346, the switch controller 344 substantially opens the bypass switch 342, although the bypass switch 342 is controlled to periodically close to provide some leakage current even when the controller 330 is in the ON state. More particularly, during the delay period, the average leakage current is controlled, e.g., by adjusting a duty cycle of a PWM signal from the switch controller 344 to the bypass switch 342, to cycle the bypass switch 342 between open and closed positions at a desired rate.

At time t2, following the delay period imposed by the delay timer 346, the switch controller 344 opens the bypass switch 342, disconnecting the dummy load 341 from its parallel arrangement with the load 320, but then cycles the bypass switch 342 between the open and closed positions, e.g., by again adjusting the duty cycle of the PWM signal, in order to continue to control the average leakage current throughout the remainder of the time during which the power switch 336 is in the close position (e.g., time t2 to time t3), which may be referred to as the controlled dummy load period. The duty cycle of PWM signal to the bypass switch 342 is higher during the delay period (e.g., time t1 to time t2) than during the subsequent controlled dummy load period (e.g., time t2 to time t3), resulting in a higher average leakage current during the delay period, as shown in FIG. 8(C). In the depicted embodiment, when the load current is not sufficient to sustain the minimum current requirement, the power switch 336 in the controller 330 may toggle ON/OFF, flickering the lights. To avoid this, additional leakage current may be maintained through the controlled dummy load period.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in the claims in parentheses, if any, are provided merely for convenience and should not be construed as limiting the claims in any way.

The invention claimed is:

1. A device for providing a bypass path for leakage current of a neutral-less controller in a lighting control system configured to selectively supply a line voltage to a lighting load, the device comprising:

a dummy load;

a voltage sensor configured to sense the line voltage at an output terminal of the neutral-less controller;

a bypass switch configured to selectively connect the dummy load in parallel with the lighting load;

a switch controller configured to activate the bypass switch to connect the dummy load in parallel with the lighting load when the sensed line voltage is low to provide a bypass path for the leakage current, and to deactivate the bypass switch after a delay period to disconnect the dummy load from being in parallel with the lighting load when the sensed line voltage is high; and a delay timer configured to implement the delay period in response to the sensed line voltage transitioning from low to high.

2. The device of claim 1, wherein deactivating the bypass switch after the delay period enables the dummy load to continue to provide the bypass path for the leakage current during the delay period, while current drawn by the lighting load increases to an amount sufficient for operation of the neutral-less controller.

3. The device of claim 1, wherein the delay period is approximately 2 seconds.

4. The device of claim 1, wherein the delay period is a predetermined time period.

5. The device of claim 1, wherein the delay period is determined in real-time or near real-time by the delay timer.

6. The device of claim 1, wherein the delay timer comprises an RC circuit.

7. The device of claim 1, wherein the bypass switch comprises a field effect transistor (FET), a metal oxide semiconductor field effect transistor (MOSFET), an Insulated Gate Bipolar Transistor (IGBT) or a Bipolar Junction Transistor (BJT).

8. The device of claim 1, wherein the switch controller comprises a microprocessor or a microcontroller.

9. The device of claim 8, wherein the microprocessor is configured to control an average leakage current of the neutral-less controller during the delay period by adjusting a duty cycle of a pulse width modulation (PWM) signal provided to the bypass switch, cycling the bypass switch between open and closed positions at a desired rate corresponding to the average leakage current.

10. The device of claim 9, wherein the microprocessor is further configured to control the average leakage current of the neutral-less controller following the delay period, during a controlled dummy load period, by further adjusting the duty cycle of the PWM signal provided to the bypass switch, cycling the bypass switch between open and closed positions at another desired rate corresponding to the average leakage current, wherein the duty cycle of PWM signal during the delay period is higher than the duty cycle of the PWM signal during the controlled dummy load period, resulting in a higher average leakage current of the neutral-less controller during the delay period than during the controlled dummy load period.

11. The device of claim 1, wherein the neutral-less controller comprises a programmable switch.

12. The device of claim 11, wherein the neutral-less controller further comprises a wireless receiver configured to receive a wireless signal for controlling operation of the programmable switch.

13. A device for providing a bypass path for leakage current of a neutral-less controller in a lighting control system, the neutral-less controller comprising a power switch configured to supply a line voltage to a lighting load when activated and to remove the line voltage from the lighting load when deactivated, the device comprising:

a bypass switch configured to selectively connect a dummy load in parallel with the lighting load in response to operation of the power switch in the neutral-less controller;

a switch controller configured to activate a bypass switch in response to deactivation of the power switch in the neutral-less controller, connecting a dummy load in parallel with the lighting load, and to deactivate the bypass switch in response to activation of the power switch in the neutral-less controller, disconnecting the dummy load from the lighting load, after a delay period; and a delay timer configured to determine the delay period in response to the activation of the power switch in the neutral-less controller.

14. The device of claim 13, wherein deactivating the bypass switch after the delay period enables the dummy load to continue to provide the bypass path for the leakage current during the delay period, while current drawn by the lighting load increases to an amount sufficient for operation of the neutral-less controller.

15. The device of claim 14, wherein the delay period is approximately 2 seconds.

16. The device of claim 14, wherein the delay period is a predetermined time period.

17. The device of claim 14, wherein the switch controller comprises a microprocessor configured to determine the delay period when the power switch in the neutral-less controller is activated.

18. A method for providing a bypass path for leakage current of a neutral-less controller configured to selectively connect a lighting load to a voltage source, the method comprising:

sensing a line voltage at an output of the neutral-less controller;

activating a bypass switch to connect a dummy load in parallel with the lighting load when the sensed line voltage is low, indicating the lighting load is disconnected from the voltage source; and deactivating the bypass switch to disconnect the dummy load from being in parallel with the lighting load when the sensed line voltage transitions to high, indicating the lighting load is connected to the voltage source via the neutral-less controller, after a delay period during which the bypass switch continues to be activated, the delay period enabling the lighting load to draw minimum supply current for operation of the neutral-less controller.

19. The method of claim 18, wherein the neutral-less controller requires the leakage current to flow through the bypass path when the sensed line voltage is low, and requires a minimum supply current when the sensed line voltage is high.

20. The method of claim 18, further comprising determining the delay period after the sensed line voltage transitions to high.

* * * * *